United States Patent [19]

Mischenko et al.

[11] 4,041,843

[45] Aug. 16, 1977

[54] AXIAL-PISTON VARIABLE-DELIVERY PUMP WITH VALVE DIRECTIONAL CONTROL OF PRESSURE FLUID

[76] Inventors: Vladimir Petrovich Mischenko, ulitsa Moskovskaya, 76, kv. 166, Azov Rostovskoi oblasti; Anatoly Yakovlevich Oxenenko, 601 mikroraion, 30, kv. 134; Vladimir Alexandrovich Mischenko, ulitsa Chebotarskaya, 47, kv. 15, both of Kharkov; Georgy Konstantinovich Vasiliev, pereulok Krasnoarmeisky, 105, kv. 16, Azov Rostovskoi oblasti; Jury Alexandrovich Gavrilenko, ulitsa Kibalchicha, 25, kv. 59, Kharkov; Vladimir Vasilievich Povelitsa, 605 mikroraion, 6, kv. 41, Kharkov; Ivan Vasilievich Kosenko, Dnepropetrovsky pereulok, 9, Kharkov, all of U.S.S.R.

[21] Appl. No.: 667,072

[22] Filed: Mar. 15, 1976

[51] Int. Cl.[2] ..... F01B 3/02

[52] U.S. Cl. ..... 91/499; 91/501; 60/484

[58] Field of Search ..... 91/499, 478, 480, 482, 91/501, 503; 417/269, 270

[56] References Cited

U.S. PATENT DOCUMENTS

| | | | |
|---|---|---|---|
| 2,844,002 | 7/1958 | Pavesi | 91/480 |
| 2,997,956 | 8/1961 | Stewart | 417/269 |
| 3,450,058 | 6/1969 | Stein | 91/507 |
| 3,741,076 | 6/1973 | Tulp | 91/501 |
| 3,757,647 | 9/1973 | Abramopaulos | 91/482 |

FOREIGN PATENT DOCUMENTS

| | | | |
|---|---|---|---|
| 224,312 | 11/1968 | U.S.S.R. | 91/501 |

*Primary Examiner*—Edgar W. Geoghegan

[57] ABSTRACT

An axial-piston variable-delivery pump with a valve directional control of the pressure fluid flow comprising a housing with an intake manifold, at least one pressure manifold and a pressure fluid admission duct. Axial borings in the housing accommodate oppositely arranged pistons capable of undergoing reciprocating motion and adapted to cooperate with driving members on the drive shaft. The pistons establish delivery chambers in the pump housing, each of them in communication with the pressure manifold through a delivery valve, and with the intake manifold through an inlet valve. The actuator spindle of the inlet valve is adapted to interact with a plunger mounted coaxially with the inlet valve and defines, together with the boring in the pump housing, a chamber in communication with a shaped surface of a cylindrical sleeve which embraces the drive shaft and is interconnected therewith for cooperative rotation. The sleeve is accommodated in an axial boring of the housing and is axially movable therein such that the depressions and the lands on the outer surface thereof define individual zones in the pump housing. One of these zones is in permanent communication with the exhaust line, while a second zone is in communication with the pressure fluid admission duct. Another plunger adapted to cooperate with the first, is accommodated in at least one of the chambers defined by the boring and the first plunger coaxially with the latter. Another duct is provided in the pump housing to admit pressure fluid to each of the zones of interaction of the plungers.

7 Claims, 9 Drawing Figures

AXIAL-PISTON VARIABLE-DELIVERY PUMP WITH VALVE DIRECTIONAL CONTROL OF PRESSURE FLUID

FIELD OF THE INVENTION

The present invention relates to the field of fluid-flow displacement pumping machines and to hydraulic drives making use of such machines, and has particular reference to an axial-piston variable-delivery pump with a valve directional control of pressure fluid, and to hydraulic drives of sheet-bending presses.

BACKGROUND

The present invention is applicable to hydraulic actuators of sheet-bending presses, wherein there is need for displacing the rods of fluid-operated power cylinders that are interlinked to the crown of the press, and in dogless crown positioning. The invention is also applicable to hydraulic actuators for road-building and load-handling machines, as well for rolling mills.

Known in the prior art is an axial-piston pump with a valve directional control of the pressure fluid flow, said pump comprising a housing with an intake and pressure manifolds and a pressure fluid admission duct adapted to communicate with a source of pressure fluid. The pump pistons are oppositely arranged in axial borings in the housing with the capability of undergoing reciprocating motion and rotation around their axis. The pistons are adapted to interact with driving members secured to the drive shaft and forming pump delivery chambers. Serving as the driving members in the given particular pump construction are wobble plates set in position on the drive shaft for cooperatively rotating therewith.

Interworking of the pistons and wobble plates occurs due to the provision of a mechanical linkage for each of the pistons with said wobble plate, said mechanical linkage comprising a spherical head provided at the piston end, and a ball socket which is seated with its spherical surface on the spherical head. The end face of the ball sockets opposite that fitted with the piston heads, are forced against the wobble plate by means of a pressure disk loaded with springs mounted inside the housing. Each of the pump delivery chambers is connected to the pressure manifold through the delivery valve, and to the intake manifold through the inlet valve. The housing has radial borings accommodating plungers arranged coaxially with the delivery valve.

The plungers are adapted to establish, together with the boring in the pump housing, a chamber connected by a duct to the shaped surface of a cylindrical sleeve mounted in an axial boring of the pump housing for axial displacement, said sleeve embracing the drive shaft and being connected thereto for cooperatively rotating therewith.

The actuator spindle of the inlet valve is adapted to interact with the plunger. The outside surface of the cylindrical sleeve has depressions bounded by lands so as to form individual zones. One of said zones is constantly in communication with the exhaust line, while the other is in communication with the pressure fluid admission duct adapted to communicate with the source of pressure fluid which establishes a pressure of about 15 kgf/cm$^2$ effective within sad zone. The pressure of the fluid is transmitted through a duct for application to the plunger, and the latter causes the inlet valve to open and maintains it in that position. The period of time during which the inlet valve is kept open is defined by the axial position of the shaped sleeve which is acutated by a tie-rod with one end pin-coupled to the sleeve, while its free end projects outside the pump housing so as to be associated with any of the heretofore known mechanisms capable of displacing the tie-rod and fixing it in a preset position.

When the pump operates at the rated delivery, a positive opening of the inlet valve occurs at the instant when the pistons are commencing the admission stroke, that is, they start moving from the top dead center towards the bottom dead center, whereas closing of the inlet valve occurs at the moment when the pistons start the return stroke. When adjusting the pump delivery at the expense of axial displacement of the shaped sleeve, the inlet valve is kept positively open during a portion of the stroke of the pistons from the bottom dead center towards the top dead center, i.e., over a part of the discharge stroke. As a result, the piston while running, expels the pressure fluid from the delivery chamber into the intake manifold.

Rotation of the drive shaft is imparted to the wobble plates to cause the pistons to reciprocate. When the pistons perform the admission stroke, that is, the volume of the delivery chambers increases, pressure fluid is admitted to pass from the intake manifold through the open inlet valve to the delivery chambers so as to fill the displacement volume vacated by the pistons. Just before the commencing of the admission stroke, the inlet valve is positively opened by the plunger by virtue of the fluid pressure exerted thereupon, and the inlet valve remains open throughout the admission stroke. This is conducive to lower hydraulic pressure losses of the valve during admission, whereby the suction capacity and operating rate of the pump are increased. Upon completion of the admission stroke, the inlet valve is closed by the action of the spring with which it is loaded, in response to relieving the fluid pressure. The pistons perform the return motion, i.e., decreasing the volume of the delivery chambers (discharge stroke), and the entire pressure fluid displaced by the pistons, flows through the delivery valve to the pressure manifold. Thus, the pump operates at maximum delivery. The fluid pressure is appplied to the plunger through the shaped surface of the cylindrical sleeve, viz., through the zone in communication with the fluid. The fluid pressure applied to the plunger is relieved likewise through the shaped surface of the cylindrical sleeve, namely, through the zone constantly in communication with the exhaust line.

The inlet valve can be kept open within any portion of the discharge stroke depending upon the preset axial position of the shaped cylindrical sleeve with respect to the pump housing. Thus, the pump produces one-half its rated delivery when the inlet valve is closed mid-way of the discharge stroke, i.e., the pressure fluid displaced by the pistons during the first half of the discharge stroke is fed to the intake manifold, and during the second half of the discharge stroke, to the pressure manifold.

When the inlet valve is not closed altogether throughout the discharge stroke, the entire pressure fluid is discharged by the piston to the intake manifold, and the pump produces zero delivery, accordingly.

The operating rate of the pump, i.e., the period of time within which the maximum delivery of the pump can be reduced to zero, is dependent upon the travelling speed of the shaped cylindrical sleeve. The low weight of the sleeve, its free travel and its relatively short stroke (20 to 25 mm) make it possible to effect sleeve displacement within a reasonably short span of time without any substantial energy expense or major constructive difficulties. The operating rate of the pump is directly proportional to the speed of travel of the control sleeve up to a certain point, whereupon further increase in the sleeve displacement speed will not result in a higher pump operating rate.

The maximum operating rate depends upon the drive shaft rotational speed and is sufficiently high over an effective range of shaft speeds.

Thus, for instance, the operating rate of the pump equals 0.03 *s* at 1000 rpm of the drive shaft, and 0.02 *s* at 1500 rpm.

When the shaped sleeve travels in a reverse direction, i.e., so as to increase the pump delivery from zero to maximum, the operating rate of the pump is practically unrestricted, being proportional to the travelling speed of the sleeve.

The high pump operating rate and its ready attainment make the afore-discussed prior-art pump applicable to great advantage in automatic control systems, high-speed hydraulic machines etc.

The above-described pump, however, suffers from the disadvantage that for displacing the shaped cylindrical sleeve from the position corresponding to zero delivery within a space of time shorter than 0.02 *s*, a considerable proportion of the pressure fluid is required, for example, for displacing the piston of the mechanism for setting the axial position of the cylindrical sleeve with respect to the pump housing.

Moreover, when the delivery chambers of the pistons are to be united into two or more groups so as to establish a split-flow pump, the shaped cylindrical sleeve which is in fact a pump delivery control device, provides during axial travel with respect to the pump housing, only a concurrent alteration of the pump delivery in each of the pump delivery lines, since the sleeve shaped surface, viz., the zone communicating with the pressure fluid admission duct, acts through the respective ducts simultaneously upon all the plungers which operate the inlet valves.

Known in the art is a pump available from the firm "Sack & Kiesselbach", wherein the delivery chambers of the pistons are banked into two or more groups, each being in communication with the pressure manifold. The number of pressure manifolds corresponds to the number of the groups.

The above pump provides for both a concurrent variation of the delivery in all the pressure manifolds and an independent change of the delivery in each of the pressure manifolds.

A simultaneous change of the delivery in all the pressure manifolds is attained by a device which serves for a concurrent control over the delivery in each of the delivery chambers. Said device is essentially a variable orifice positioned in the pressure fluid admission line to the pump intake manifold.

The delivery chambers of the pistons are in communication with the pressure manifold through the delivery valves, and with the pressure manifold through the inlet valves. To effect an independent control of the amount of pressure fluid discharged by each of the pistons into the pressure manifold, each of the inlet valves is provided with a linkage actuator for a positive opening of the valve and for keeping it open over the discharge stroke. This serves to cut off one or a group of the pistons from operation for a preset period of time within which the delivery in one of the pressure manifolds drops to a required value.

Such a positive opening of the inlet valves substantially complicates the pump construction and, in addition, is applicable only to low-delivery pumps, e.g., under 20 to 25 l/min, since the control of delivery in a pump having a delivery in excess of 20 to 25 l/min by virtue of throttling the flow of pressure fluid admitted to the piston chambers, causes cavitation phenomena in the pistons, followed by destruction of the elements of the piston delivery chambers.

Hydraulic drives used to effect in-step traversing of two or more fluid-operated power cylinders (hydraulic motors) can be classified largely into three groups viz., synchronized hydraulic drives comprising devices capable of synchronizing the travelling speed of the cylinder rods; cophased hydraulic drives incorporating devices adapted to establish synchronism in the mutual position of the cylinder rods; and synchrocophased hydraulic drives provided with devices ensuring synchronization of the travelling speed of the cylinder rods, and devices to effect synchronism in the mutual position of the cylinder rods.

In synchronized hydraulic drives with synchronization of the travelling speeds of the cylinder rods, the required accuracy is attained by metering the amount of fluid admitted to the fluid-operated power cylinders or hydraulic motors. In the synchronized hydraulic drives used currently, the metering is carried out by means of:

throttles or flow velocity governors mounted in the delivery or exhaust lines of fluid-operated power cylinders;

series-communicated pressure chambers of power cylinders;

special metering cylinders;

flow dividers (adders);

auxiliary control cylinders (hydraulic motors);

reference and dual pumps;

metering devices of hydraulic motors, or pumps operating as hydraulic motors.

Synchronized hydraulic drives are only capable of rough synchronism, since they fail to take account of the difference in the geometric volume of the fluid-operated power cylinders, the condition of their sealing elements, and the elasticity and temperature expansion of pressure fluid, the pipings and the power cylinders.

In cophased hydraulic drives, a continuous synchronization of the mutual position of the cylinder rods is carried out by means of:

a rigid mechanical linkage between fluid-operated power cylinders;

a feedback coupling to compensate for an error in the position of the cylinder rods with the use of servo-systems. Cophased hydraulic drives are mostly capable of a required accuracy of synchronism; however, hydraulic drives with a rigid mechanical coupling are bulky, whereas those with compensation of the cylinder rod position error by means of servo-systems suffer from considerable energy losses and a restricted range of operating speeds within which the hydraulic driver performs a stable operation free from self-vibrations.

Synchro-cophased hydraulic drives adapted to synchronize the travelling speed of the cylinder rods and their mutual position, are in fact a combination of several design versions of the synchronized and cophased hydraulic drives. The most commonly encountered version of a synchro-cophased hydraulic drive utilized in hydraulic presses is a combination of dual pumps and a feedback coupling to compensate for an error of the mutual position of the cylinder rods by virtue of an appropriate redistribution of pressure fluid fed by the pumps.

Known in the art is a synchro-cophased hydraulic drive for a sheet-bending press.

Said known hydraulic drive comprises fluid-operated power cylinders whose rods are interconnected with the crown of the press, a device for measuring the position error of the cylinder rods, a dual variable-delivery pump, a means to protect the delivery lines against overloads, and a source of pressure fluid.

The device for measuring the position error of the cylinder rods is made as a flexible linkage such as chain or wire rope, one of the ends of which is connected to the stationary press member, and the other end is held in position on one of the lever arms, while the other arm thereof is adapted to interact with the spool of a three-position triple-port servo-valve. The middle segment of the flexible linkage is adapted to interact with two sprockets or rollers that are free to rotate around a pivot secured to the press crown. The dual variable-delivery pump incorporates two pumps, each being connected with its drive shaft to the motor shaft through a common gear reducer.

Said dual pump has a device for varying its delivery which makes it possible for each pump to deliver into the pressure manifold practically the same amount of pressure liquid irrespective of the position assumed by the device.

The delivery line of each pump is communication, through the valve capable of keeping the crown in position upon ceasing the delivery of pressure fluid by the pump, with the inlet of a four-port directional control valve in communication with the source of pressure fluid. The latter in turn is in communication with a safety valve which is to maintain constant pressure in the delivery line of the source of pressure fluid.

One outlet line of the first four-port directional control valve in communication with the rod space of the first fluid-operated power cylinder, whereas the other outlet line is in communication with the head space of the second fluid-operated power cylinder. One outlet line of the second four-port directional control valve is in communication with the rod space of the second fluid-operated power cylinder, whereas the other outlet line is in communication with the head space of the first fluid-operated power cylinder. The fourth line of each directional control valve is in communication with the exhaust line. The means for protecting the delivery lines against overloading by the dual pump is fashioned as a servo-actuated safety valve which, when in the initial position, is normally open, and the delivery line of each pump is in communication with the exhaust line through the check valve and the normally open safety valve. When the fluid-operated power cylinder is operative, the safety valve is closed so as to maintain a preset operating pressure in the delivery lines of the dual pump.

One of the lines of the triple-port servo-valve is in communication with the exhaust line, while the other two lines are in communication with the delivery lines of the dual pump.

When the hydraulic drive operates, e.g., for the crown to travel from the top dead center towards the bottom dead center, the safety valve is closed, while the four-port directional control valves are so set that pressure fluid from the delivery lines of the dual pump is fed to the piston-head spaces of the fluid-operated power cylinders, while the piston-rod spaces of the latter are in communication through said directional control valves with the exhaust line. If the press crown runs askew due an erroneous positioning of the rods of the fluid-operated power cylinders, the flexible linkage deflects the lever arm with which it is interconnected, whereas the other arm of the lever causes the spool of the triple-port servo-valve to travel so as to bypass part of the pressure fluid passing from the dual pump delivery line, into the piston-head space of the advancing power cylinder and further to the exhaust line, thereby bringing the cylinder rods in synchronism.

In case of overloads, i.e., when the pressure in the dual pump delivery lines rises above a specified level, the servo-actuated safety valve lets the pump-delivered pressure fluid bypass to the exhaust line, thereby maintaining the pressure in the delivery lines within the preset limits.

The known hydraulic drive, however, sustains additional hydraulic losses stemming from throttling of the pressure fluid when passing through the triple-port servo-valve.

Moreover, said hydraulic drive is capable of but a restricted range of operating speeds of the cylinder rods, within which a stable traversing of the rods is ensured, with a broad range of effective pressures in the fluid-operated power cylinders. This is due to the fact that the servo-valve flow-rate characteristic curve is very steep at pressures approximating the upper limit of the effective pressure range. Due to such a steep curve, great acceleration of the cylinder rods occurs which results in overshooting of the synchronous position of the cylinder rods. Such over-shooting brings the cylinder rods into self-vibration which leads to imposition by heavy loads upon the press and eventually to impaired quality of sheet stock bending.

Furthermore, the known hydraulic drive fails to provide dogless stopping of the press crown when the latter approximates a preset position which involves the use of stop dogs adapted to take up the press force, whereby said stop dogs are made massive and bulky, thus adding to the weight of the press and taking much time to be readjusted for stopping the crown in another position.

SUMMARY OF THE INVENTION

It is therefore a primary object of the present invention to extend the field of application of an axial-piston variable-delivery pump with a valve directional control of pressure fluid, which resides in the possibility of employing the pump in systems of hydraulic machines and mechanisms for solving such problems, for example, as overload protection of spontaneous movement of the system, prevention of the operative member of a hydraulic-actuated machine, such as the crown of a sheet-bending press, synchronization of movement of two or more hydraulic actuators, such as pistons of fluid-operated power cylinders of a sheet-bending press, and stopping one or all the hydraulic actuators in a preset position, e.g., the pistons of fluid-operated power cylinders of a sheet-bending press.

It is another object of the present invention to increase the efficiency of the hydraulic drive by virtue by reduced energy and hydraulic losses.

A further object of the present invention is to provide higher stability of the press hydraulic drive within a broad range of loads and operating speeds of the press.

In keeping with the aforesaid and other objects the essence of the present invention resides in that in an axial-piston variable-delivery pump with a valve directional control of the pressure fluid flow, comprising a housing with an intake manifold, at least one pressure manifold and a pressure fluid admission duct, said housing being provided with axial borings, wherein pistons are oppositely arranged, said pistons being capable of reciprocating along said borings and adapted to coact with the driving members secured with the drive shaft so as to establish pump delivery chambers, each being in communication with the pressure manifold through the delivery valve, and with the intake manifold through the inlet valve, the actuator spindle of the latter valve being adapted to interact with the plunger arranged coaxially with said inlet valve, and to define, together with the boring in the pump housing, a chamber which is in communication with the shaped surface of a cylindrical sleeve that embraces the drive shaft, said sleeve being accommodated in an axial boring of the pump housing so as to travel axially therealong, which sleeve is interconnected with the drive shaft so as to rotate therewith, said sleeve having a number of depressions on the outside surface thereof, said depressions being bounded by lands to form individual zones, one of said zones being constantly in communication with the exhaust line, while the other, is in communication with the pressure fluid admission duct. According to the invention at least one of the chambers formed by the boring and the plunger accommodates another plunger arranged coaxially with the first one and adapted to interact therewith, and another duct is provided in the pump housing to admit pressure fluid to either of the zones of interaction of the plungers.

The coaxial arrangement of the latter plunger with respect to the first one, and the provision of another duct in the pump housing to admit pressure fluid to pass to the zone of interaction of both plungers makes it possible to open the inlet valve during the admission stroke irrespective of the position assumed by the control sleeve and keep it open for a required space of time. Thus, pressure fluid admitted to the delivery chamber during the admission stroke is displaced backward into the intake manifold, thereby relieving the delivery chamber for a required period of time.

This feature enables a stepwise control of the pump delivery. If the second plunger is provided in all the borings, and each zone of interaction of the plungers has its own pressure fluid admission duct, admission of presssure fluid to said zones in a preset sequence makes it possible to vary the pump delivery rate in steps, whereby the initial rate of the pump delivery can be reduced stepwise depending upon the position of the control sleeve.

It is expedient that said other ducts for admission of pressure fluid to the zones of interaction of the plungers be arranged in the herein-considered axial-piston variable-delivery pump, into at least one group.

Due to such arrangement of the ducts for admitting pressure fluid to the zones of interaction of the plungers into one group the possibility is provided for reducing pump delivery to zero regardless of the position assumed by the control sleeve and maintaining zero delivery for a required period of time.

Such arrangement of said ducts also enables a reduction of the delivery of some group of pistons to zero.

It is desirable that the plunger of the axial-piston variable -delivery pump has a tailpiece, and that the other plunger be made as a ring located on the tailpiece of the former plunger.

Such an embodiment is instrumental in decreasing the depth of the space accommodating both of the plungers and in certain cases makes it possible to cut down the weight and size of the pump.

For a normal operation of the plungers accommodated in the space the length of said plungers should be not less than their diameter, whereby the total length of both plungers is approximately equal to two diameters thereof.

When a ring is fitted onto the plunger tail-piece, the total length of the plungers when assembled may be equal to their diameter, to provide normal seizure-free operation thereof. On the other hand, if the tailpiece diameter is selected to be equal to or approximately the ring thickness, the ring-to-tailpiece joint will operate likewise without jamming, that is, due to the above embodiment the total length of the plunger and the ring may also be not in excess of the plunger diameter.

It is recommendable that the delivery chambers of the pistons in the axial-piston variable-delivery pump of the invention be intercommunicated into at least two groups, each of them being in communication through said delivery valves, with the pressure manifold, the number of such manifolds corresponding to that of said groups.

Such an integration of the pump delivery chambers into groups each of which is communicated through the delivery valves with the pressure manifold contributes to the possibility of splitting the pump delivery into portions. The number of the pressure manifolds equals that of the piston groups in such a manner that said groups may unite either an equal number of the delivery chambers, or any arbitrary number of such chambers, thus enabling the utilization of a required proportion of the pump delivery without affecting the remainder delivery portions. The uniting of the pump delivery of the chambers into groups may be carried out according to an appropriate pattern concerned with the association of these pump chambers and the ducts for admitting pressure fluid to the zones of interaction of the plungers. Thus, for instance, the pump delivery chambers are integrated into two groups, and the pressure fluid admission ducts are made in such a manner that the groups of the delivery chambers correspond to the groups of the pressure fluid admission ducts along which the pistons get relieved when pressure fluid is fed to the zones of interaction of the plungers.

As a result, a synchronous or concurrent delivery variation is attained in two pressure manifolds due to traversing of the control sleeve, as well as mutually independent variation of the delivery down to zero in each of the delivery flow irrespective of the position assumed by the control sleeve.

The objects of the invention can also be achieved in an axial-piston variable-delivery pump with a valve directional control of pressure fluid, comprising a housing with an intake manifold, at least one pressure manifold and a pressure fluid admission duct, said housing being provided with axial borings, wherein pistons are oppositely accommodated, said pistons being capable of reciprocating along the said borings and adapted to coact with the driving members locked-in with the drive shaft so as to establish pump delivery chambers, each of said chambers being in communication with the pressure manifold through the delivery valve, and with the intake manifold through the inlet valve, the actuator spindle of the latter valve being adapted to interact with the plunger arranged coaxially with said inlet valve and to define, together with the boring in the pump housing, a chamber which is in communication with the shaped surface of a cylindrical sleeve that embraces the drive shaft, said sleeve being accommodated in an axial boring of the pump housing so as to axially travel therealong, which sleeve is interconnected with the drive shaft so as to rotate together therewith, and has a number of depressions on the outside surface thereof, said depressions being bounded by lands to form individual zones, one of said zones being constantly in communication with the exhaust line, while the other is in communication, with the pressure fluid admission duct. According to the invention each of the plungers has an annular groove running on the lateral surface of said plunger around the entire periphery thereof, and another pressure fluid admission duct is provided in the pump housing, said duct being in communication with said chamber, an additional spring-actuated plunger being movably mounted in said duct, the tailpiece of said additional plunger being adapted to coact with the lateral surface of said plunger when pressure fluid is fed along said duct.

BRIEF DESCRIPTION OF THE DRAWINGS

Other objects and advantages of the present invention will become obvious from a consideration of the following exemplary embodiments thereof and the accompanying drawings, wherein.

DETAILED DESCRIPTION

Figure 1:
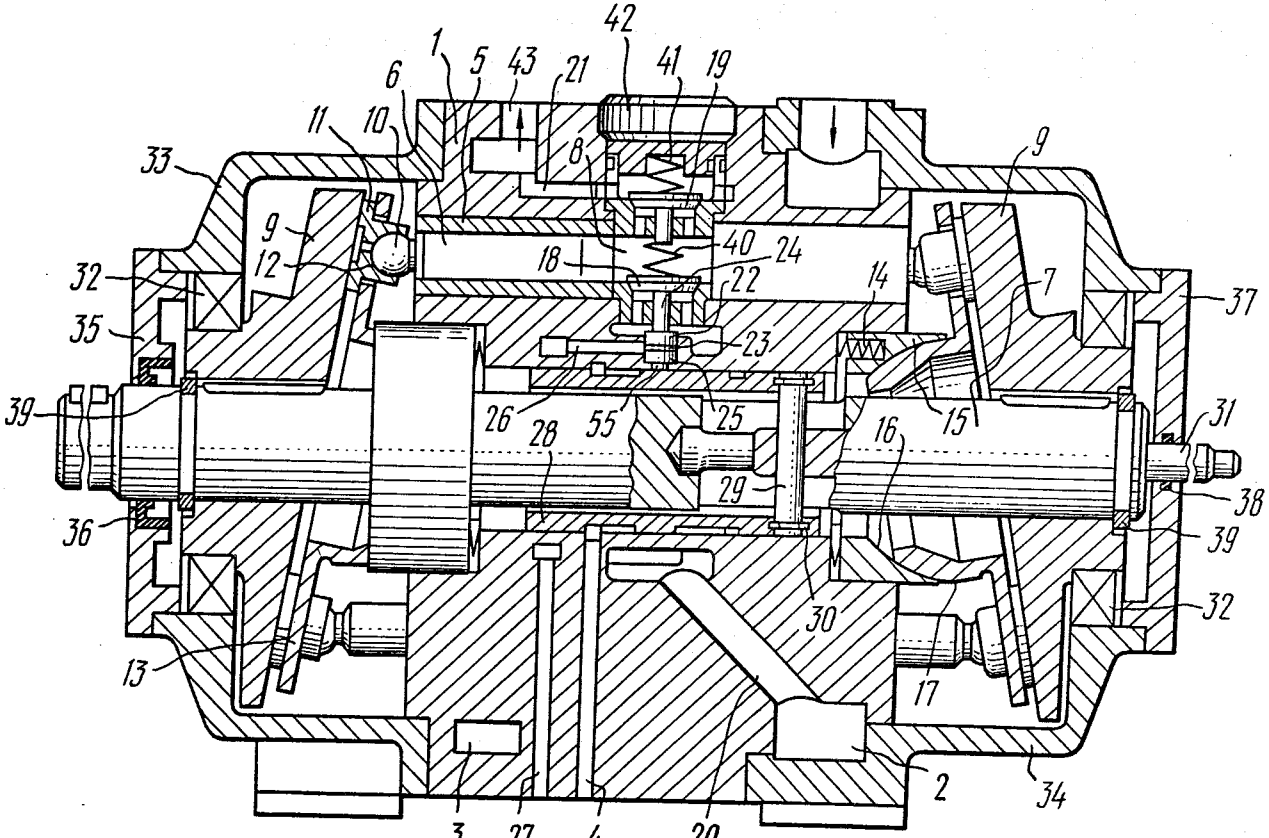
FIG. 1 is a schematic longitudinal-section view of an axial-piston variable-delivery pump, according to the invention.

Reference is directed to the accompanying drawings showing an axial-piston variable-delivery pump with a valve directional control of the pressure fluid flow, wherein according to the invention it comprises a housing 1 (FIG. 1) with an intake manifold 2, a pressure manifold 3 and a pressure fluid admission duct 4 which is in communication with a source of pressure fluid (not shown). The housing 1 is provided with axial borings, spaced equidistantly from the housing axis into which sleeves 5 are pressed, said sleeves accommodating pistons 6 adapted to reciprocate along said sleeves and rotate around their own axis. The pistons 6 are adapted to coact with driving members secured to a drive shaft 7 for cooperatively rotating therewith, and to define pump delivery chambers 8 in the housing 1. Serving as the driving members in the herein-considered pump embodiment are wobble plates 9 which are key-seated on the drive shaft 7. Interaction of the pistons 6 with the wobble plates 9 occurs due to a mechanical coupling of each of the pistons 6 with said wobble plate 9, said mechanical coupling of each piston with the wobble plate being effected through a spherical head 10 provided on the end of the piston 6, and ball socket 11 which with its spherical surface 12 is fitted on the spherical head 10 of the piston 6. The ball sockets 11 with their end face opposite to that fitted to the heads 10 of the pistons 6, are forced against the wobble plates 9 by means of pressure disks 13.

The force with which the disks 13 press the ball sockets 11 against the wobble plates 9 is exerted by springs 14 which are housed in seats 15 movably mounted in an axial boring of the housing 1 and thrust against the latter. The force of the springs 14 is applied to a concave-dished surface 16 of the spring seat 15 and is relayed to the pressure disk 13 through a convex-dished surface 17. Each of the pump delivery chambers 8 is in communication with the intake manifold 2 through an inlet valve 18, and with the pressure manifold 3 through a delivery valve 19. The communication of each pump delivery chamber 8 with the intake manifold 2 is established along ducts 20, and with the pressure manifold 3, along ducts 21. A number of radial borings are provided in the housing 1 to accommodate the delivery valves 19 and the inlet valves 18. Plungers 22 are mounted coaxially with the inlet valves 18 so as to define, together with the boring in the housing 1, chambers 23. Each of the plungers 22 is adapted to interact with an actuator spindle 24 of the inlet valve 18. In all the chambers 23 there is mounted another plunger 25 coaxial with the plunger 22 and adapted to interact therewith. A number of ducts 26 are provided in the housing 1, said ducts being in communication with the chambers 23 within the zone of interaction of the ends of the plungers 22 and 25. Another duct 27 is provided in the housing 1 for pressure fluid admission, said duct being in communication with the ducts 26, where by pressure fluid is admitted to pass to the zone of interaction of the ends of the plungers 22, 25. The housing 1 has an axial boring, wherein a cylindrical shaped sleeve 28 is axially movable, said sleeve embracing the drive shaft 7 and being interconnected with the latter for cooperatively rotating therewith. The sleeve 28 is interconnected with the drive shaft 7 through a pin 29 fixed in the sleeve 28 by means of washers 30 and interconnected with a tie-rod 31. The latter is adapted to be coupled with any known mechanism (not shown) for axially traversing the sleeve 28, said traversing effecting the variation of the pump delivery. The wobble plates 9 are mounted in bearings 32 housed in a front cover 33 and a rear cover 34. A flange 35 is fastened on the cover 33, wherein a seal 36 of the shaft 7 is accommodated, while a flange 37 accommodating a seal 38 for the tie-rod 31, is made fast on the cover 34.

To take up the thrust exerted by the pistons 6 upon the wobble plates 9, half-rings 39 are mounted on the shaft 7.

The inlet valve 18 is biased by a spring 40, while the delivery valve 19 is loaded by a spring 41. The radial recesses in which the inlet valve 18 and the delivery valve 19 are mounted, are closed by plugs 42 on the side of the delivery valves. The pump has a delivery line 43 adapted to feed pressure fluid to consumers.

Figure 2:
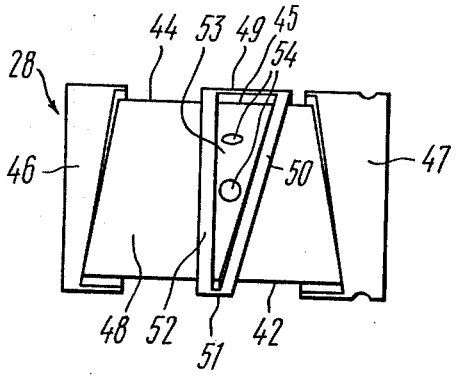
FIG. 2 illustrates a cylindrical shaped-surface sleeve, according to the invention.
Figure 3:
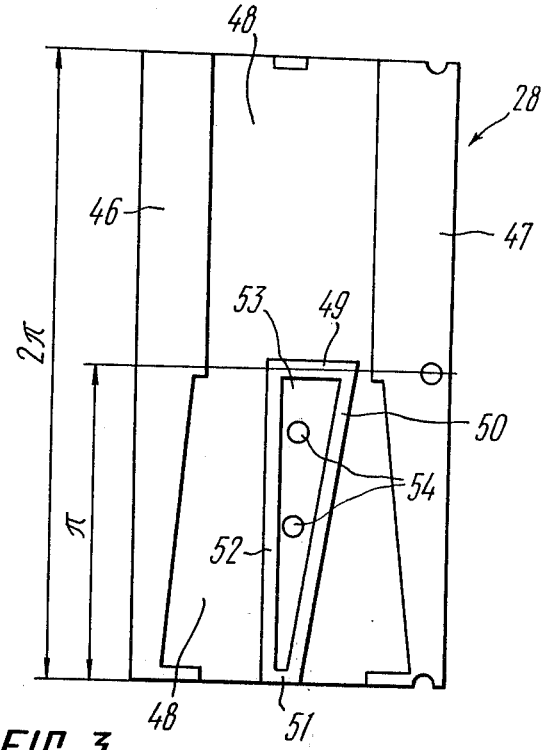
FIG. 3 is an enlarged view of the cylindrical shaped-surface sleeve, according to the invention.

Depressions 44 and 45 (FIGS. 2, 3) are provided on the outside cylindrical surface of the sleeve 28, the depression 44 being bounded by lands 46 and 47 which define a zone 48 in communication with the duct 4 (FIG. 1) for admitting pressure fluid at a pressure of 15 kgf/cm$^2$.

The depression 45 (FIGS. 2, 3) is confined within lands 49, 50 51, 52 that form a zone 53 permanently in communication with the exhaust line through outlet ports 54. The extent of the zone 53 is about one-half the extent of the zone 48. Pressure fluid is admitted to the zone between the lands 46 and 52, said zone defining the length of the axial traverse of the sleeve 28. Each of the chambers 23 (FIG. 1) is in communication through a duct 55 with the cylindrical surface of the sleeve 28.

The pump according to the invention operates as follows.

Rotation of the shaft 7 causes rotation of the wobble plates 9 and the shaped cylindrical sleeve 28. Ball sockets 11 forced against the wobble plates 9 and articulated to the pistons 6, coact therewith, thus converting rotation of the wobble plates 9 into reciprocating motion of the pistons 6. The sleeve 28 is positioned circumferentially relative to the shaft 7 that at the beginning of the admission stroke, the land 49 overlaps the duct 55. Upon further rotation of the shaft 7, i.e., under the admission stroke, the zone 48 to which pressure fluid is admitted is the duct 4, comes into communication with the chamber 23 through the duct 55. When the pistons 6 travel so as to increase the volume of the delivery chambers 8 (admission stroke), the inlet valve 18 is opened by virtue of the pressure exerted by the hydraulic fluid, said pressure also causes the other plunger 25 to undergo travel. The plunger 25 interacts with the plunger 22 which, while travelling, interacts with the actuator spindle 24 of the valve 18 to open the latter and maintain it open throughout the admission stroke. Upon completion of the admission stroke, the land 51 overlaps the duct 55, thus isolating the chamber 23 from the zone 48. Upon further rotation of the shaft 7, i.e. during the discharge stroke, the zone 53 in constant communication with the exhaust line through the duct 55, comes into communication with the chamber 23. The inlet valve 18 is urged to close by the tension of the spring 40. The pistons 6 start travelling in the reverse direction, i.e., to reduce the volume of the delivery chambers 8 (discharge stroke), and the entire amount of pressure fluid expelled by the pistons 6 passes through the delivery valve 19 along the duct 21 to the pressure manifold 3. Thus, the pump develops its maximum delivery.

Upon varying the delivery of the pump, a mechanism (not shown) causes the tie-rod 31 to travel axially, and together therewith the cylindrical sleeve 28 interconnected with the tie-rod.

Depending upon a preset axial position of the sleeve 28, the inlet valve 18 is kept open over a part of the travel of the pistons 6 during the discharge stroke. The operating pattern of the pump remains invariable during the admission stroke. During the discharge stroke the zone 48 comes into communication with the chamber 23 through the duct 55, and the valve 18 is kept open. With the pistons 6 travelling for decreasing the volume of the delivery chambers 8, pressure fluid is displaced through the inlet valve 18 to pass along the duct 20 into the intake manifold 2. During the discharge stroke, the land 50 overlaps the duct 55 on a part of the travel of the pistons 6 so that the chamber 23 comes out of communication with the zone 48. Then the zone 53 is in communication with the chamber 23 through the duct 55, the spring 40 urges the inlet valve 18 to close and part of the pressure fluid is displaced by the pistons 6 through the delivery valve 19 along the duct 21 into the pressure manifold 3. Thus, the pump develops a fractional delivery.

By displacing the sleeve 28 to its extreme position, the zone 48 becomes constantly communicated with the chamber 23 through the duct 55, and the inlet valve 18 is maintained open both during the admission and discharge strokes. Pressure fluid that has filled the delivery chambers 8 during the admission stroke, is now completely expelled into the intake manifold 2 which corresponds to zero delivery of the pump.

Upon admitting the fluid pressure to the duct 27, the fluid travels through the ducts 26 to the zones of interaction of the plungers 22 and 25 within the chamber 23 to keep the inlet valves 18 open regardless of the axial position of the sleeve 28.

In another embodiment of the pump, according to the invention, a plunger 56 (FIG. 4) has a tailpiece 57, while another plunger 58 is made as a ring located on the tailpiece 57 of the plunger 56. Such a version of the pump enables the depth of the chamber 23 to be reduced, which is some cases makes it possible to cut down the weight and size of the pump.

The pump operating sequence is similar to that described above.

Figure 5:
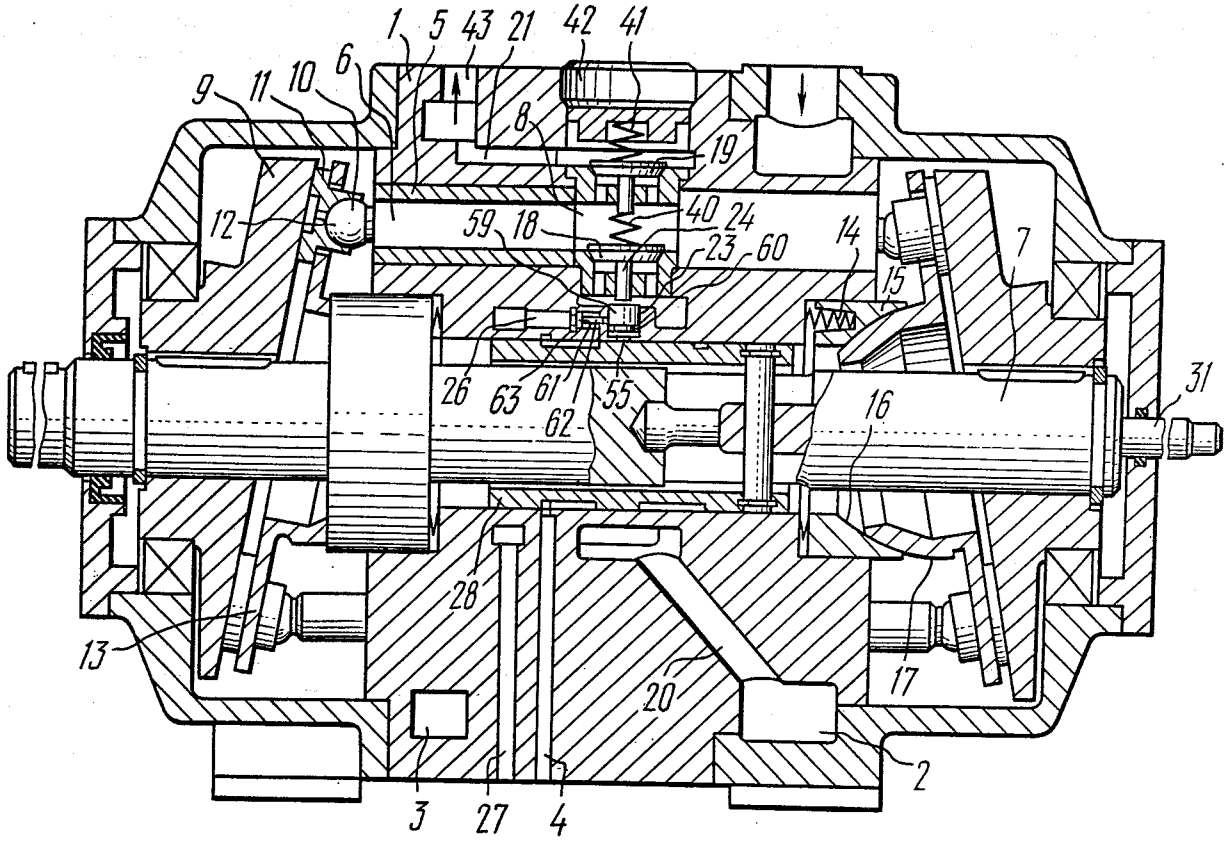
FIG. 5 is a longitudinal-section view of an axial-piston variable-delivery pump, according to an other embodiment of the invention.

In one more modification of the pump, according to the invention, each plunger 59 (FIG. 5) has an annular groove 60 on its lateral surface throughout the periphery thereof, whereas the other pressure fluid admission duct 26 accommodates an additional spring-actuated plunger 61 slidably mounted therein and provided with a tailpiece 62. A check ring 63 is provided in the duct 26 to fix the plunger in axial position.

The pump operating procedure is similar to that described above with the exception that when pressure fluid is fed to the duct 27 it passes to the ducts 26 and urges the plunger 61 to travel and interact with its tailpiece 62 with the lateral surface of the plunger 59. Interaction of the tailpiece 62 with the annular groove 60 causes the plunger 61 to be fixed in position so as to keep the inlet valve 18 open irrespective of the axial position of the sleeve 28.

Figures 4, 6:
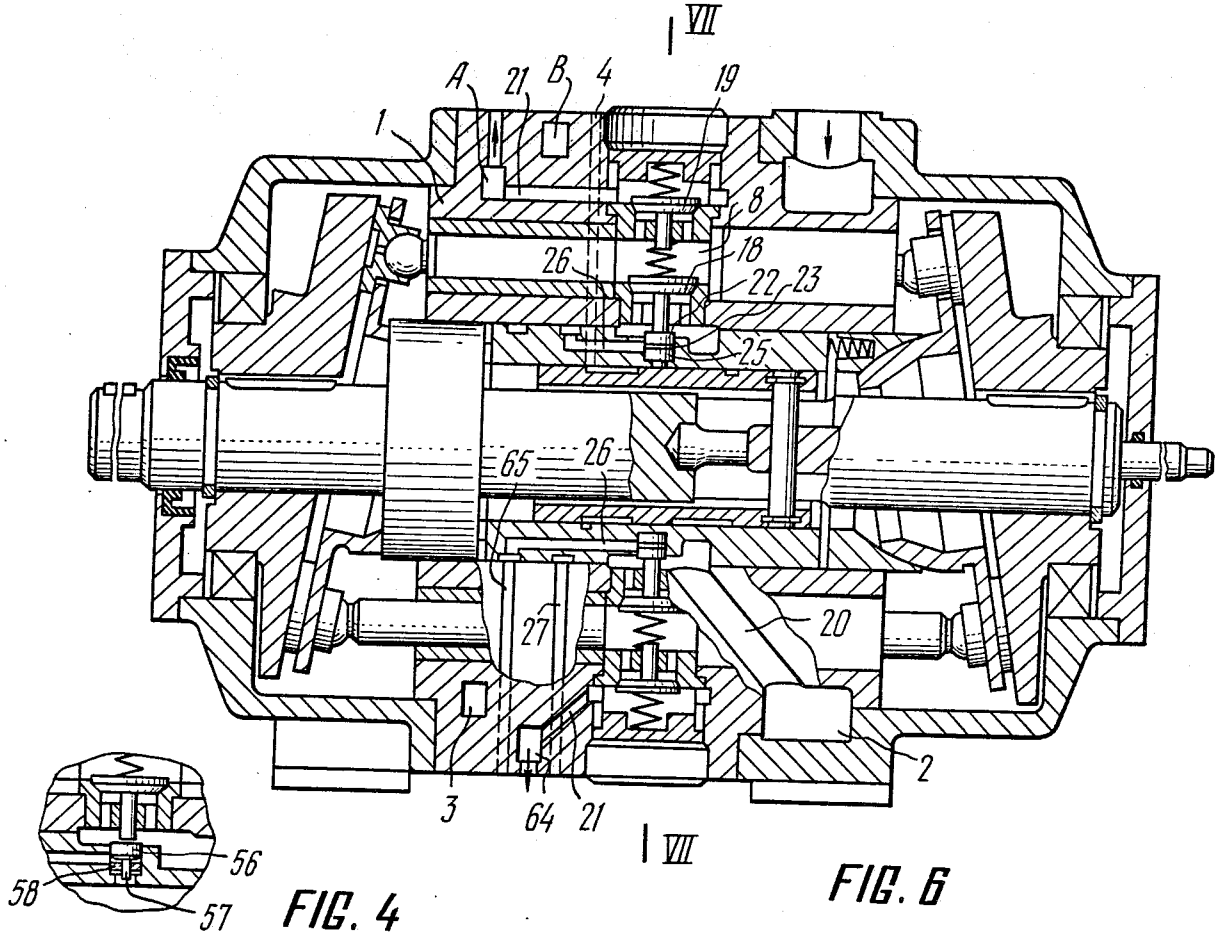
FIG. 4 is s section of another embodiment of the plungers, according to the invention.
FIG. 6 is another embodiment of the axial-piston pump, according to the invention.
Figure 7:
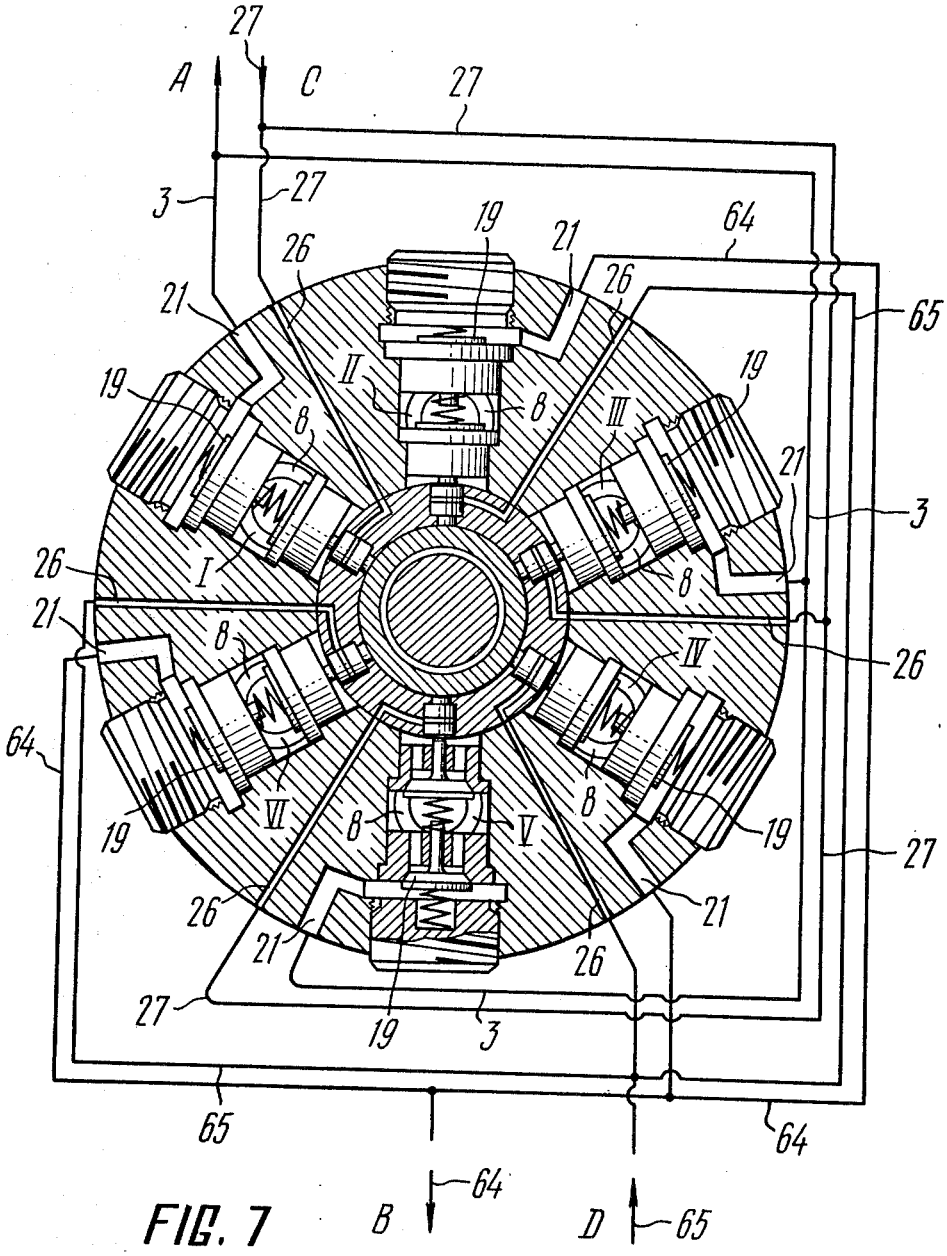
FIG. 7 is a section taken along line VII—VII in FIG. 6.

In cases where the herein-disclosed axial-piston pump is used in hydraulic drives whose operation involves two pressure fluid flow, the delivery chambers 8 of the pistons 6 are divided into two groups A and B (FIGS. 6 and 7). The group A covers the delivery chambers 8 indicated at I, III, V which are in communication through the delivery valves 19 and the ducts 21 with the pressure manifold 3. The delivery chambers 8 indicated at II, IV, VI are arranged in group B and in communication through the delivery valves 19 and the ducts 21 with a pressure manifold 64.

Whenever it becomes necessary to vary the delivery rate of one of the fluid flows independently of that of the other flow, the ducts 26 for pressure fluid admission to the zone of interaction of the plungers 22 and 25 are arranged in two groups C and D, the group C being established by the ducts 26 in communication with the duct 27, while the group D is composed of the ducts 26 in communication with a duct 65.

The delivery rate of pressure fluid in group A is varied due to admission of the pilot pressure fluid to group C, while the delivery rate of pressure fluid in the group B is varied due to admission of the pilot pressure fluid to the group D.

The pump operates according to the pattern discussed hereinabove.

The hydraulic drive (FIG. 8) of, for example, a sheet-bending press, incorporates the variable-delivery pump (FIG. 6) with two delivery lines 66 and 67, two fluid-operated power cylinders 68 and 69 whose connecting rods 70 and 71 are interconnected with a crown 72, a device 73 for measuring the position error of the rods 70, 71, said device being adapted to interact with the spring-actuated spool of a three-position triple-port directional control valve 74.

The pump is interconnected with a motor 75 (FIG. 8) through the drive shaft 7 (FIG. 6), and has the ducts 27 and 65 (FIGS. 6, 7) for pressure fluid admission to the groups C and D of the zones of interaction of the plungers.

Pilot pressure fluid admitted to pass to the duct 27 causes the delivery in the line 66 to drop to zero, while fluid admitted to pass to the duct 65 produces a similar variation of the delivery rate in the line 67.

The hydraulic drive of the invention also comprises a means 76 for overload protection of the lines 66 and 67, and a source 77 of pilot pressure fluid, said source being in communication through a pipe-line 78 with an inlet line 79 of a three-position four-port directional control valve 80 and with a safety valve 81, the latter establishing the required pilot pressure of the fluid.

The drive shaft of the source 77 of pilot pressure fluid is associated with the shaft of the pump for a cooperative rotation.

The spool of the directional control valve 80 is operated by solenoids 82.

The delivery line 66 is in communication with an inlet line 83 of a three-position four-port directional control valve 84 governed by the directional control valve 80.

An outlet line 85 of the directional control valve 84 is in communication with a piston-end space 86 of the fluid-operated power cylinder 68, whereas an outlet line 87 of the valve 84 is in communication through a valve 88 with a piston-rod space 89 of the fluid-operated power cylinder 69. The delivery line 67 is in communication with an inlet line 90 of a three-position four-part directional control valve 91 governed by the directional control valve 80.

An outlet line 92 of the directional control valve 91 is in communication with a piston-end space 93 of the fluid-operated power cylinder 69, while an outlet line 94 of the directional control valve 91 is in communication through a valve 95 with a piston-rod space 96 of the fluid-operated power cylinder 68.

The valves 88 and 95 are capable of holding the crown 72 in position upon cessation of pressure fluid admission by the pump.

The directional control valve 84 and 91 are in communication with the exhaust line through conduits 97 and 98.

An outlet line 99 of the directional control valve 80 is in communication with a control chamber 100 of the directional control valve 84 and with a control chamber 101 of the directional control valve 91.

An outlet line 102 of the directional control valve 80 is in communication with a control chamber 103 of the directional control valve 84 and with a control chamber 104 of the directional control valve 91.

A conduit 105 of the directional control valve 80 is in communication with the exhaust line.

The device 73 comprises a roller 106 whose shaft 107 is fixed in position on the crown 72 for traveling cooperatively therewith, and an arm actuator 108 which assumes the position parallel to the movement of the crown 72 when the rods 70 and 71 perform in-phase motion. One of the ends of the arm actuator 108 is articulated to the stationary press member, viz., a bracket 109 of the fluid-operated power cylinder 68, while its other end is adapted to interact with a spool 110 of the directional control valve 74. The arm actuator is adapted also to interact with the roller 106.

A conduit 111 of the directional control valve 74 is in communication with the source 77 of pilot pressure fluid, a conduit 112 is in communication with the duct 27 (FIG. 6) of the group C (FIG. 7) of the zones of interaction of the plungers 22, 25 (FIG. 6) of the pump, and a conduit 113 (FIG. 8) is in communication with the duct 65 (FIG. 6) of the group D (FIG. 7) of the zones of interaction of the plungers 22, 25 (FIG. 6). Additionally, the conduit 112 (FIG. 8) is in communication via a throttle valve 114 and a conduit 115 with the exhaust line, while the conduit 113 is in communication through a throttle valve 116 and a conduit 117 also with the exhaust line.

The overload protection means 76 is effected as two-position double-port directional control valves 118 and 119.

The directional control valve 118 has a spring-actuated spool 120 and is in communication through a control chamber 121 with the pump delivery line 66, through an inlet line 122 with the source 77 of pilot pressure fluid, and through an outline line 123 with the duct 27 (FIG. 6) of the group C (FIG. 7) of the zones of interaction of the plungers 22, 25 (FIG. 6) of the pump. The directional control valve 119 (FIG. 8) has a spring-actuated spool 124 and is in communication through a control chamber 125 with the pump delivery line 67, through an inlet line 126 with the source 77 of pilot pressure fluid, and through an outlet line 127 with the duct 65 (FIG. 6) of the group D (FIG. 7) of the zones of interaction of the plungers 22, 25 (FIG. 6) of the pump.

Figure 8:
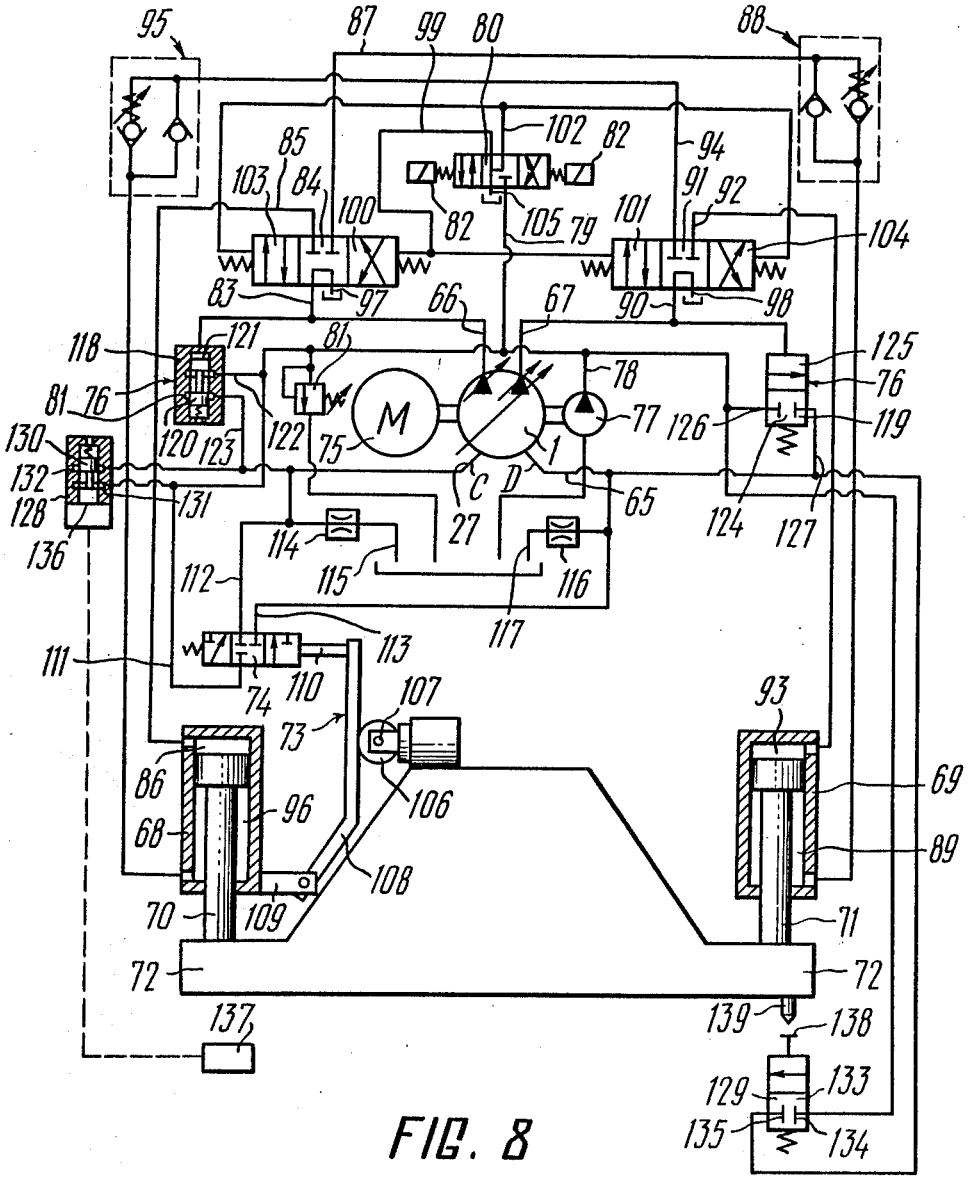
FIG. 8 is a diagrammatic view of a hydraulic drive of a sheet-bending press, according to the invention.

The above-disclosed hydraulic drive is capable of a dogless positioning of the crown 72 (FIG. 8). To this end, provision is made therein for two sliding spool valves 128 and 129. The valve 128 has a spring-actuated spool 130 and is in communication through an inlet port 131 with the source 77 of pilot pressure fluid, and through an outlet port 132 with the duct 27 (FIG. 6) of the group C (FIG. 7) of the zones of interaction of the plungers 22, 25 (FIG. 6) of the pump. The valve 129 (FIG. 8) has a spring-actuated spool 133 and is in communication via an inlet port 134 with the source 77 of pilot pressure fluid, and through an outlet port 135 with the duct 65 (FIG. 6) of the group D (FIG. 7) of the zones of interaction of the plungers 22, 25 (FIG. 7) of the pump.

An end 136 (FIG. 8) of the spool 130, opposite to the spring-actuated spool end, is adapted to interact with a stop 137 located on the press (not shown), while an end 138 of the spool 133, opposite to the spring-actuated spool end, is adapted to interact with a stop 139 also located on the press.

The stops 137 and 139 define the position of the bottom dead center of the crown 72.

The hydraulic drive according to the present invention operates as follows. When starting the motor 75 whose shaft is geared with the pump drive shaft, the solenoids 82 are deenergized, and pressure fluid forced by the pump into the delivery lines 66 and 67, is admitted through the respective conduits 97 and 98 of the directional control valves 84 and 91 to the exhaust line.

Concurrently with the pump, the source 77 feeds pilot pressure fluid to the pipeline 78 and further on, along the inlet line 79 to the spool of the directional control valve 80, along the conduit 111 to the spool of the directional control valve 74, along the inlet lines 122 and 126 to the respective spools 120 and 124 of the respective directional control valves 118 and 119, and along the respective inlet ports 131 and 134 to the spools 130 and 133 of the respective sliding spool valves 128 and 129. Thus, when the solenoids 82 are deenergized and the crown 82 assumes a synchronous position at the top dead center, all the lines, conduits and inlet ports of the respective directional control valves and sliding spool valves mentioned hereinabove, are closed by the respective spools. Pilot pressure fluid admitted to pass into the pipe line 78, overflows through the safety valve 81, and the required pressure of that fluid is established in the pipeline 78.

If the crown 72 is to be displaced from the top dead center towards the bottom dead center, the solenoid is to be energized. As a result, the spool 80 is displaced to communicate the line 79 with the line 102, and the line 99 with the conduit 105. Thus, pilot pressure fluid is free to pass from the source 77 along the pipeline 78, the lines 79 and 102 into the control chambers 103, 104 and to displace the spools of the direction control valves 84 and 91, thus expelling the fluid from the control chambers 100 and 101 into the line 99 and the conduit 105 of the directional control valve 80 to the exhaust line. At that instant, the line 83 of the directional control valve 84 comes into communication with the line 85, and the line 87, with the conduit 97. The same occurs with the directional control valve 91, that is, the line 90 comes into communication with the line 92, and the line 94, with the conduit 98.

Pressure fluid forced by the pump is passed along the lines 66, 83 and 85 to the piston-end space 86 of the fluid-operated power cylinder 68, and along the lines 67, 90 and 92, to the piston-end space 93 of the fluid-operated power cylinder 69, thus urging the cylinder rods 70 and 71 to move.

Pressure fluid is expelled to the exhaust line from the piston-rod space 96 through the valve 95 and along the line 94 and the conduit 98, and from the piston-rod space 89 throgh the valve 88 and along the line 87 and the conduit 97.

If the rods 70, 71 fall out of synchronism while moving from the top dead center towards the bottom dead center, e.g., the rod 70 advances the rod 71, the crown 72 runs askew, and the roller 106 presses the arm actuator 108 to swivel at its joint. While swivelling, the arm actuator 108 displaces the spool 110 of the directional control valve 74 so as to provide communication between the conduit 111 and the conduit 112, wherefrom the pilot pressure fluid passes into the duct 27 (FIG. 6) of the pump.

The amount of pressure of the fluid admitted to the duct 27 is in ratio with the amount of displacement of the spool 110 (FIG. 8) of the directional control valve 74 within an estimated range of displacements. The pilot pressure fluid admitted to the duct 27 (FIG. 6) causes a diminished delivery of pressure fluid by the pump (FIG. 8) to the line 66 as compared to the delivery of that fluid to the line 67. Such a diminished delivery of pressure fluid to the line 66 will result in a reduced travelling speed of rod 70 until the crown 72 assumes the required position, and the the spool 110 is spring-actuated to return to the initial position so as to interrupt communication of the conduit 111 with the conduits 112 and 113. Upon isolation of the conduits 111 and 112, the pilot pressure fluid is passed from the duct 27 (FIG. 6) of the pump (FIG. 8) through the throttle valve 114 to the conduit 115 and then to the exhaust line, with the result that the pressures in the duct 27 (FIG. 6) of the pump and in the duct 65 become equalized.

With pressure equilibrium in the ducts 27 and 65, the pump delivers equal amounts of pressure fluid to the lines 66 and 67 said fluid urging the rods 70, 71 (FIG. 8) to move further on at the same speed.

If the crown 72 is to be displaced from the bottom dead center towards the top dead center, the solenoid 82 is to be deenergized and the other solenoid 82 must be energized to actuate the spool of the directional control valve 80 to travel to the other extreme position so as to provide communication with and the line 99, and the line 102 with the conduit 105.

Pilot pressure fluid is admitted from the source 77 to pass along the lines 78, 79, 99 to the control chambers 100 and 101 to displace the spools of the directional control valves 84 and 91 which expel the fluid from the control chambers 103 and 104 into the line 102 and the conduit 105 and further on to the exhaust line. As a result, the lines 83 and 87 of the directional control valve 84 come into communication, and so does the line 85 with the conduit 97; at the same time the line 90 of the directional control valve 91 is in communication with the line 92, and the line 94 with the conduit 98.

Pressure fluid delivered by the pump is fed along the lines 66, 83, 87 through the valve 88 to the piston-rod space 89 of the fluid-operated power cylinder 69, and along the lines 67, 90, 94 through the valve 95 to the piston-rod space 96 of the fluid-operated power cylinder 68 so as to urge the rods 70 and 71 to move; the result is that the crown 72 travels from the bottom dead center towards the top dead center. The rods 70 and 71 expel the pressure fluid from the piston-end space 86 along the line 85 and the conduit 97, and from the piston-end space 93 along the line 92 and the conduit 98 to the exhaust line.

If the rods 70, 71 fall out of synchronism while moving from the bottom dead center towards the top dead center, e.g., the rod 70 advances the rod 71, the crown 72 runs askew and the roller 106 disengages the arm actuator 108 which is made to swivel around its articulated joint by the action of the spring of the spool 110, with the result that the spool 110 is so displaced as to provide communication between the conduit 111 and the conduit 113 along which pilot pressure fluid is admitted to the pump duct 65. When admitted to the pump, said fluid causes a reduction in the delivery of pressure fluid by the pump into the line 67 as compared to the delivery of that fluid to the line 66. A reduced delivery of pressure fluid to the line 67 leads to a decreased travel speed of the rod 70 until the crown 72 assumes its proper position, and the spool 110 is acted upon by the arm actuator 107 which is turned by the roller 106 into its initial position, to assume the initial position and interrupt communication between the conduit 111 and the conduits 113 and 112.

Upon isolation of said conduits, pilot pressure fluid is passed from the duct 65 of the pump through the throttle valve 116 and the conduit 117 to the exhaust line, and the pressure in the pump ducts 65 and 27 becomes equalized. With pressure equilibrium in the ducts 27 and 65, the pump delivers equal amounts of pressure fluid to both delivery lines thereof.

Thus, correction of deflection of the crown 72 from a preset position during its travel occurs due to a decreased delivery of pressure fluid fed by the pump to the delivery line that is in communication with the space of the advancing rod. Upon correcting the position of the crown 72, the pump delivers practically the same amount of pressure fluid to both the delivery lines 66 and 67.

When the fluid pressure rises to the maximum permissible level, e.g., in the pump delivery line 66, the spool 120, while being acted upon by that pressure, displaces to compress the spring and provide communication between the line 122 and the line 123, along which pilot pressure fluid passes from the source 77 to the duct 27 of the group C (FIG. 7) of the zones of interaction of the plungers 22, 25 (FIG. 6). Upon introduction into the duct 27 (FIG. 8), the pilot pressure fluid decreases the delivery of pressure fluid to the line 66 down to an amount that is enough to compensate for volumetric losses in the system at a maximum permissible effective pressure therein, and thus cannot call forth a further rise of the pressure above the maximum permissible level. The restriction of a maximum permissible pressure in the pump delivery line 67 occurs in the same way as described above.

A dogless stopping of the crown at the bottom dead center takes place as follows. Upon approximating the crown 72 to the bottom dead center for a preset distance, the stops 137 and 139 displace the respective spools 130 and 133.

The spool 130 provides communication between the inlet port 131 and the outlet port 132, whereby pilot pressure fluid is free to pass from the source 77 to the duct 27. The spool provides communication between the inlet port 134 and the outlet port 135, and pilot pressure fluid is admitted to pass from the source 77 to the duct 65. The magnitude of the pilot pressure of the fluid in the ducts 27 and 65 is in a ratio with the amount of displacement of the respective spools 130 and 133. Once the magnitude of pilot pressure of the fluid in the duct 27 has reached that at which the pump delivers such an amount of pressure fluid to the line 66 that is enough only to compensate for hydraulic leaks in the system under operating pressure, the rod 70 stops. A dogless stopping of the rod 71 occurs in a similar way. Apart from the pattern of the hydraulic drive operation described above which utilizes the capabilities of the herein-proposed pump, some other patterns of such hydraulic drives are also practicable, wherein a pilot pressure of the fluid is developed in the ducts 27 and 65 in response to an oblique setting of the crown 72, causing a reduced delivery of pressure fluid to the delivery line in communication with the space of the advancing rod, thus eliminating the position error of the rods.

Figure 9:
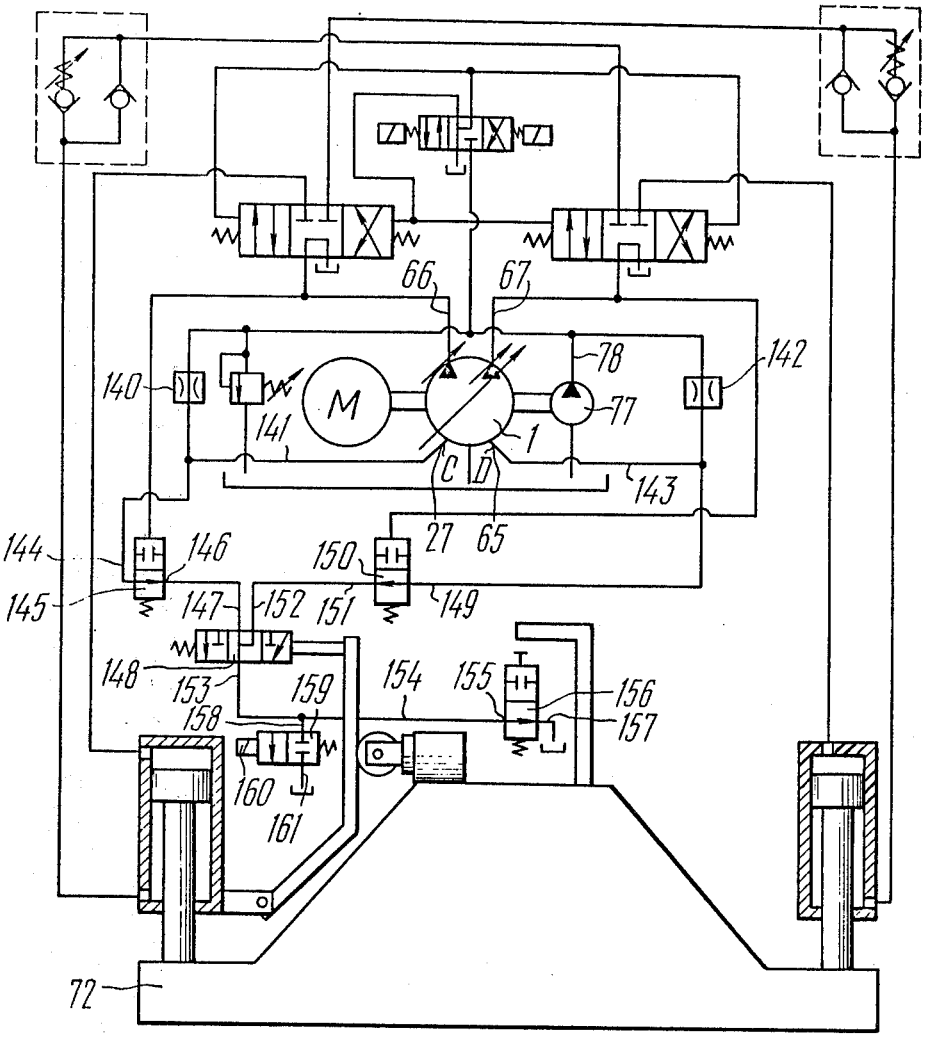
FIG. 9 illustrates another embodiment of the hydraulic drive of a sheet-bending press, according to the invention.

Another embodiment of the hydraulic drive (FIG. 9) is similar to the afore-described with the exception of the following features. The source 77 of pilot pressure fluid is in communication via a throttle valve 140 and a pipeline 141 with the duct 27, and through a throttle valve 142 and a pipeline 143 with the duct 65 of the pump.

In communication with the pipeline 141 is an inlet line 144 of a two-position double-port directional control valve 145 whose outlet line 146 is in communication with a conduit 147 of a three-position triple-port directional control valve 148, whereas in communication with the pipeline 143 is an inlet line 149 of a two-position double-port directional control valve 150 whose outlet line 151 is in communication with a conduit 152 of the directional control valve 148. A conduit 153 of the latter valve is in communication through a pipeline 154 with an inlet port 155 of a sliding spool valve 156. An outlet port 157 of the latter valve is communicated to the exhaust line. In communication with the pipe-line 154 is an inlet line 158 of a two-position double-port directional control valve 159 whose spool is operated by a solenoid 160, while an outlet line 161 of the directional control valve 159 is in communication with the exhaust line.

When the crown 72 travels straight without cocking and the effective pressure in the lines 66, 67 is within the permissible level, pilot pressure fluid is admitted from the source 77 through the throttle valve 140 to the pipeline 141, the lines 144 and 146 of the directional control valve 145, the conduits 147 and 153 of the directional control valve 148, the inlet port 155 and further on, through the outlet port 157 of the valve 156 to the exhaust line. Pilot pressure fluid passing from the source 77 runs through the throttle valve 142, the pipeline 143, the lines 149 and 151 of the directional control valve 150, the conduits 152 and 153 of the directional control valve 148, the inlet port 155 and the outlet port 157 of the valve 156 to the exhaust line. That is, the pilot pressure fluid fed from the source 77 to the pump ducts 27 and 65 through the throttle valves 140 and 142, is directed to the exhaust line, so that the pressure of the fluid in the ducts 27 and 65 is equalized which corresponds to an equal delivery of pressure fluid to the delivery lines 66 and 67.

When the pressure of the power fluid in the line 66 increases to a maximum permissible magnitude, the force of that pressure urges the spool of the directional control valve 145 to compress the spring and move to interrupt communication between the line 144 and the line 146, whereupon the pilot pressure fluid fed through the throttle 140 and the duct 27 increases the pressure to a level corresponding to the delivery of such an amount of pressure fluid by the pump to the line 66 that is enough only to compensate for volumetric losses in the system at a maximum permissible pressure therein, but does not suffice for increasing the pressure of the power fluid above the maximum permissible level. In a similar way, limiting of the maximum permissible magnitude of pressure in the pump delivery line 67 occurs.

The setting of the crown 72 to a straight travel after having run askew is as follows. An oblique travel of the crown calls forth a corresponding travel of the spool of the directional control valve 148 which shuts off the exhaust of the pilot pressure fluid from either of the ducts 27 and 65, wherein a rise of the pilot pressure causes a reduced delivery of pressure fluid to the delivery line that is in communication with the space of the advancing rod. A reduction of the delivery of pressure fluid to the space of the advancing rod leads to a diminished speed of the advancing rod, whereupon the crown 72 travels straight, and the spool of the directional control valve 148 is returned to the initial position, whereas the pressure in the ducts 27 and 65 is equalized.

When the crown 72 approaches the bottom dead center for a pre-estimated distance, the stoppage of the crown causes the spool of the sliding spool valve 156 to move and isolate the inlet port 155 from the outlet port 157, so that the pilot pressure fluid fed from the source 77, is free to flow through the throttle valves 140 and 142 to the pipelines 141 and 143, thus raising the pressure in the ducts 27 and 65 to a level at which the pump delivers such an amount of pressure fluid to the lines 66 and 67 that is enough to compensate for the volumetric losses in the system at the working pressure therein but is not enough for further traversing of the crown. Upon energizing the solenoid 160, the two-position double-port directional control valve 159 becomes operative to provide communication between the line 158 and the line 161. Thus, the pilot pressure fluid is admitted to pass from the duct 27 along the lines 144 and 146 of the directional control valve 145 to the conduits 147 and 153 of the directional control valve 148, and from the duct 65 along the lines 149 and 151 of the directional control valve 150 to the conduits 152 and 153 of the directional control valve 148, and further on through the lines 158 and 161 of the directional control valve 159 to the exhaust line. This is conducive to a rapid travel of the crown 72 from the bottom dead center at which it has been retained with the help of the stop acting upon the spool of the sliding spool valve 156.

What is claimed is:

1. An axial-piston variable-delivery pump with a valve directional control of the pressure fluid flow, comprising:

a. a housing having an axis, said housing having an intake manifold, at least one pressure manifold, one pressure fluid admission duct, axial borings spaced equidistantly from the axis of said housing, radial borings and a further axial boring;

b. a drive shaft mounted in said further axial boring;

c. driving members secured to said drive shaft;

d. pistons oppositely arranged in said axial borings of the housing, said pistons being free to reciprocate in said borings, and to coact with said driving members and establish pump delivery chambers in said axial borings;

e. delivery valves to provide communication between said pump delivery chambers and said pressure manifold;

f. inlet valves to provide communication between said pump delivery chambers and said intake manifold;

g. actuator spindles for said inlet valves;

h. a cylindrical sleeve slidably mounted in said further axial boring of the housing, said sleeve embracing said drive shaft and being interconnected therewith so as to rotate cooperatively therewith, said cylindrical sleeve having an outer surface provided with a number of depressions and lands which bound said depressions to define individual zones, one of said zones being in constant communication with an exhaust line, while another of said zones is in communication with said pressure fluid admission duct; said depressions and lands forming a shaped surface on said cylindrical sleeve;

i. a plurality of first plungers each of which is accommodated in one of said radial borings in the housing coaxially with said inlet valve to cooperate with said actuator spindle of said inlet valve and establish, together with said radial boring of said housing, a chamber in said housing in communication with said shaped surface of the cylindrical sleeve;

j. at least one further plunger accommodated in at least one of said chambers coaxially with said first plunger to interact therewith; said housing having at least one further duct to admit pressure fluid to the zone of interaction of said plunger.

2. An axial-piston variable-delivery pump with a valve directional control of the pressure fluid flow, said pump comprising: a housing having an axis, said housing having an intake manifold, at least one pressure manifold, a pressure fluid admission duct, axial borings spaced equidistantly from the axis of said housing, radial borings and one further axial boring; a drive shaft mounted in said further axial boring; driving members secured to said drive shaft; pistons oppositely arranged in said axial borings of the housing, said pistons being accommodated to reciprocate along said borings and to coact with said driving members and establish pump delivery chambers in said axial borings; delivery valves to provide communication between said pump delivery chambers and said pressure manifold; inlet valves to provide communication between said pump delivery chambers and said intake manifold; actuator spindles for said inlet valves; a cylindrical sleeve slidably mounted in said further axial boring of the housing, said sleeve embracing said drive shaft and being interconnected therewith to rotate cooperatively therewith, said cylindrical sleeve having an outer surface provided with a number of depressions and lands which bound said depressions to define individual zones, one of said zones being in constant communication with an exhaust line, while another of said zones is in communication with said pressure fluid admission duct; said depressions and lands forming a shaped surface on said cylindrical sleeve; a plurality of plungers, each having an annular groove on its lateral surface around the entire periphery thereof, each plunger being accommodated in one of said radial borings of the housing coaxially with said inlet valve to interact with said actuator spindle of said inlet valve and establish, together with said boring in said housing, a chamber in communication with said shaped surface of said cylindrical sleeve; said housing having at least one further pressure fluid admission duct in communication with said chamber; a further spring-actuated plunger slidably mounted in said further pressure fluid admission duct; a tailpiece on said further plunger, said tailpiece being positioned to interact with said lateral surface of said plunger when the pressure fluid is admitted to pass along said further duct.

3. An axial-piston variable-delivery pump as claimed in claim 1, wherein said delivery chambers of the pistons are arranged at least two groups, each of which is in communication through said delivery valves with said pressure manifold, the number of which corresponds to that of said groups.

4. An axial-piston variable-delivery pump as claimed in claim 2, wherein said delivery chambers of the pistons are arranged at least two groups, each of which is in communication through said delivery valves with said pressure manifold, the number of which corresponds to that of said groups.

5. An axial-piston variable-delivery pump as claimed in claim 3, wherein said another pressure fluid admission ducts are arranged in at least one group.

6. An axial-piston variable-delivery pump as claimed in claim 4, wherein said further pressure fluid admission ducts are arranged in at least one group.

7. An axial-piston variable-delivery pump as claimed in claim 1, wherein said plunger has a tailpiece, said further plunger being constituted as a ring located on said tailpiece of the first said plunger.

* * * * *